US006132193A

United States Patent [19]

Kolb et al.

[11] Patent Number: 6,132,193

[45] Date of Patent: Oct. 17, 2000

[54] DISPLACEMENT MACHINE FOR COMPRESSIBLE MEDIA

[75] Inventors: Roland Kolb, Regensdorf; Fritz Spinnler, Mellingen, both of Switzerland

[73] Assignee: SIG Schweizerische Industrie-Gesellschaft, Neuhausen am Rheinfall, Switzerland

[21] Appl. No.: 09/140,676

[22] Filed: Aug. 26, 1998

[30] Foreign Application Priority Data

Aug. 26, 1997 [CH] Switzerland ..... 1984/97

[51] Int. Cl.[7] ..... F03C 2/00

[52] U.S. Cl. ..... 418/55.3; 418/55.1; 418/15

[58] Field of Search ..... 418/55.3, 55.1, 418/15

[56] References Cited

U.S. PATENT DOCUMENTS

| | | | |
|---|---|---|---|
| 4,861,244 | 8/1989 | Kolb et al. | 418/15 |
| 4,950,138 | 8/1990 | Spinnler | 418/55.3 |
| 4,998,864 | 3/1991 | Muir | 417/410 |
| 5,024,589 | 6/1991 | Jetzer et al. | 418/55.3 |
| 5,318,425 | 6/1994 | Jetzer et al. | 418/55.6 |
| 5,322,426 | 6/1994 | Kolb | 418/55.2 |
| 5,356,276 | 10/1994 | Spinnler | 418/55.2 |

FOREIGN PATENT DOCUMENTS

| | | | |
|---|---|---|---|
| 0 557 598 | 9/1993 | European Pat. Off. . | |
| 42 03 346 | 8/1992 | Germany . | |
| 226585 | 10/1986 | Japan | 418/15 |
| 199984 | 9/1987 | Japan | 418/15 |
| 202692 | 9/1991 | Japan | 418/15 |
| 404262085 | 9/1992 | Japan | 418/15 |
| 673 680 | 3/1990 | Switzerland . | |

*Primary Examiner*—Thomas Denion
*Assistant Examiner*—Theresa Trieu
*Attorney, Agent, or Firm*—Oblon, Spivak, McClelland, Maier & Neustadt, P.C.

[57] ABSTRACT

A housing (7") of the displacement machine for compressible media includes an end wall (28). Placed onto the housing (7") in the axial direction is a hood (50), which, together with the end wall (28), bounds a space (51). The two inlets (12, 12'), which are located on the outside in the radial direction, are connected to each other by this space. For its part, the hood (50) has a nozzle-like connection (52), via which the displacement machine can be connected to an upstream air filter. The displacement machine needs little space, as viewed in the radial direction.

14 Claims, 5 Drawing Sheets

DISPLACEMENT MACHINE FOR COMPRESSIBLE MEDIA

BACKGROUND OF THE INVENTION

1. Field of the Invention

The present invention relates to a displacement machine for compressible media.

2. Description of the Related Art

A displacement machine of this type is disclosed in the Swiss patent number 673 680. It has an approximately cylindrical housing with end walls and a peripheral outer wall. Integrally molded on the outer wall are connecting flanges which each have an inlet opening, are located diametrically opposite each other and are directed radially outward. Arranged in the housing are delivery spaces which lead in the manner of a spiral from the inlet openings to an outlet, which is located radially on the inside. A displacer cooperates with the delivery spaces and, during operation, together with the walls of the delivery spaces bounds a plurality of approximately sickle-shaped working spaces, which move from the inlets, through the delivery spaces, to the outlet, the volume of the working spaces being continuously reduced, because of the different curvature of the spiral shape, and the pressure of the operating medium being correspondingly increased thereby. Displacement machines of this type are distinguished by low-pulsation delivery of the gaseous operating medium, which consists of air or an air/fuel mixture, for example, and can therefore also advantageously be used for the purpose of charging internal combustion engines. In this case, the two inlet openings have to be combined, for example by means of a pipe system, in order to connect them to an upstream device, for example an air filter. This requires an undesirable amount of space, particularly in the radial direction.

A displacement machine having a single inlet opening that is arranged on an end wall of the housing is disclosed by DE-A-42 03 346. In the interior of the housing, a first delivery space leads from this inlet opening and, radially on the outside in relation to the latter, a channel leads away and leads to a second delivery space which is arranged to be offset by 180° in relation to the first delivery space. Viewed in the radial direction, this embodiment also requires large external dimensions of the housing.

SUMMARY OF THE INVENTION

Thus, it is one of the objects of the present invention to develop a generic displacement machine in such a way that it can be connected to an upstream device in a simple way whilst requiring little space in the radial direction.

The inventive hood connects the inlet openings to each other in a simple and space-saving way. Only a single connecting line to an upstream device is needed.

The inventive hood is accompanied by further advantages. Thus, it has a stiffening effect on the housing, which is particularly advantageous if the latter is composed of two or more parts. In addition, as indicated in dependent claims, said hood can accommodate a mounting, on which the reaction forces of a drive for the displacement machine are absorbed.

BRIEF DESCRIPTION OF THE DRAWINGS

The invention will now be explained in more detail with reference to exemplary embodiments which are illustrated in the drawing, in which, purely schematically.

DETAILED DESCRIPTION OF THE PREFERRED EMBODIMENTS

Figure 1:
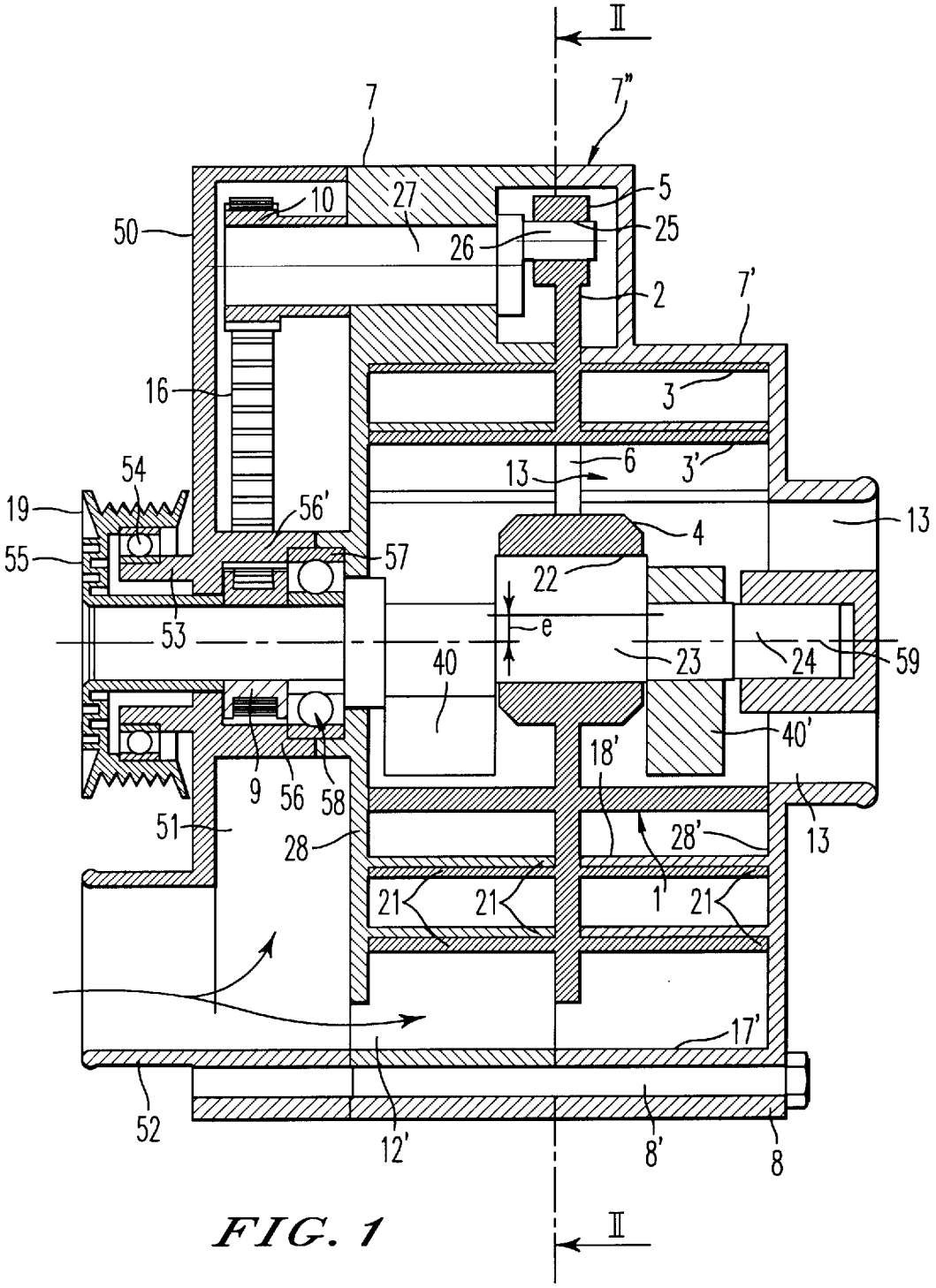
FIG. 1 shows a first embodiment of the inventive displacement machine, in longitudinal section along the line I—I of FIG. 2.

The displacement machines illustrated in the drawing have a rotor which acts as a displacer 1. It has, on both sides of a disk 2, in each case two displacement bodies which are arranged to be offset by at least approximately 180° in relation to one another, run spirally and are formed by bars 3, 3' that are held perpendicularly on the disk 2. In the example shown, the spirals themselves are formed from a plurality of circular arcs which adjoin one another. Because of the large ratio, which can be seen from FIG. 2, between the axial length and the wall thickness, the inlet-side end region 3" of the bars 3, 3' is in each case of reinforced design. 4 designates a hub, by way of which the disk 2 is drawn onto a bearing 22. The bearing 22 itself is seated on an eccentric disk 23 which, for its part, is part of a drive shaft 24; the axis of rotation of the drive shaft 24 is designated by 59. 5 designates an eye which belongs to the disk 2, which is arranged radially outside the bars 3, 3' and is intended to accommodate a guide bearing 25, which is drawn onto an eccentric pin 26. For its part, the latter is part of a guide shaft 27. The eccentricity e of the eccentric disk 23 on the drive shaft 24 corresponds to that of the eccentric pin 26 on the guide shaft 27. At the outlet-side end of the bars 3, 3', apertures 6 are made in the disk 2, in order that an operating medium can pass from one side of the disk to the other, for example in order to be led away through a central outlet 13 in a half-housing 7' that is placed on the right in FIGS. 2 and 3. 19 designates a pulley, which is rotationally fixedly connected to the drive shaft 24. By means of this pulley 19, the displacer 1 is driven via the drive shaft 24. 40, 40' are centrifugal weights which are fitted to the drive shaft 24. They serve to balance the centrifugal force that is exerted by the displacer 1 on the eccentric disk 23 during the operation of the machine.

Figure 2:
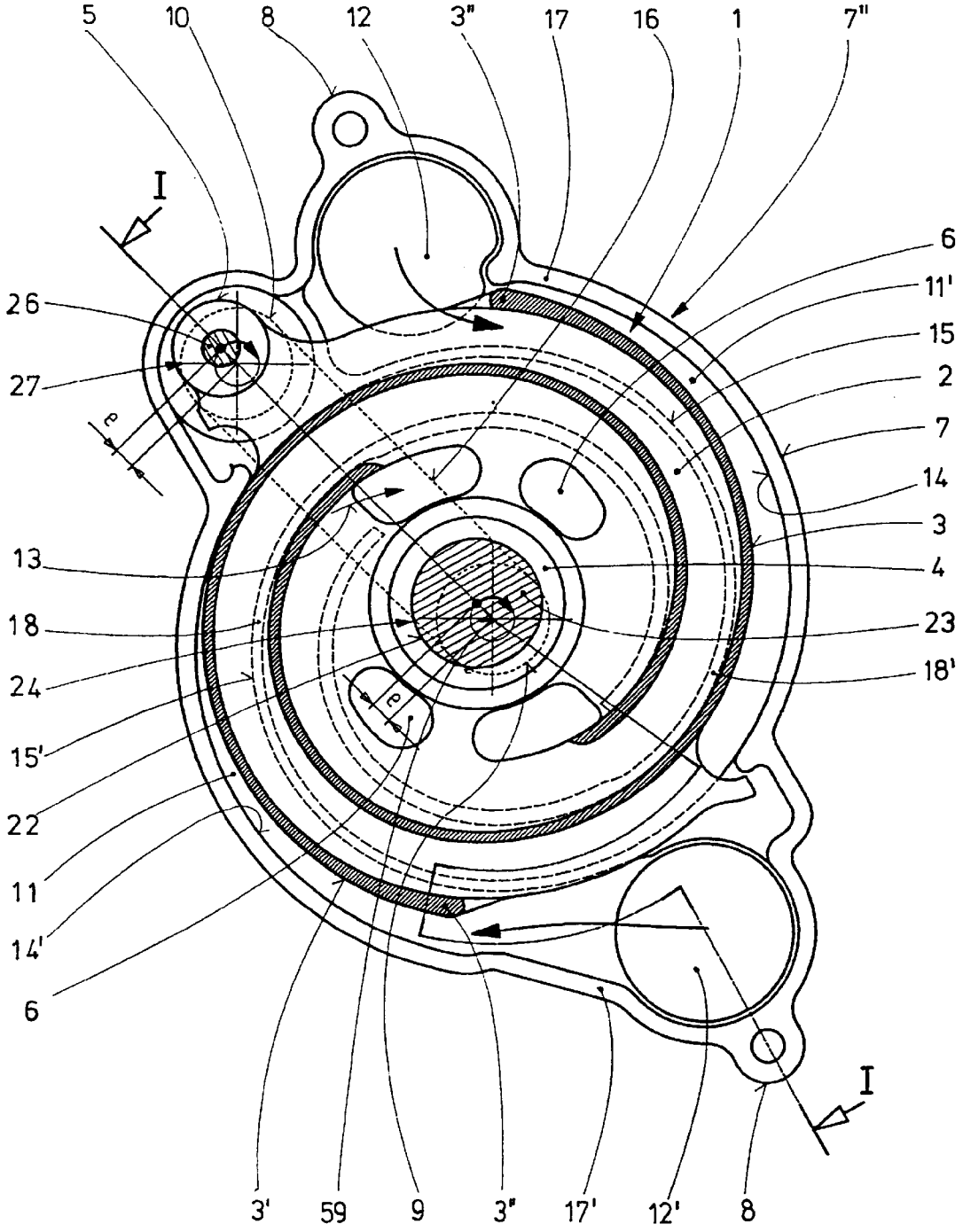
FIG. 2 shows the housing, parted along the line II—II of FIG. 1, of the displacement machine with a displacer arranged in the housing.

FIG. 2 shows a half-housing 7, illustrated on the left in FIG. 1, of a machine housing 7" that is composed of the two half-housings 7 and 7' which adjoin each other in the axial direction and are connected to each other via fastening eyes 8 which serve to accommodate screw fixings 8'. 11 and 11' designate two delivery spaces which are in each case offset at least approximately by 180° in relation to each other and are machined in the manner of a spiral slot into the two half-housings 7, 7'. They run in each case from an inlet 12, 12' that is arranged at the radially outer end of the spiral slot in the housing 7" to the outlet 13, which is located radially on the inside, is common to both delivery spaces 11, 11' and is integrally molded on the housing part 7'. Said delivery spaces have essentially parallel cylinder walls 14, 14', 15, 15', which are arranged at a constant distance from one another and, in the present case, like the bars 3, 3' forming the displacement body, form a spiral of about 360°. The bars 3, 3' engage between these cylinder walls 14, 14' and 15, 15', the curvature of said bars being such that they virtually touch the inner and outer cylinder walls 14, 14', 15, 15' of the housing 7" at a plurality of points, for example at two points in each case, which are spaced apart from one another as viewed in the circumferential direction. During operation, the bars 3, 3' execute with each of their points a circular movement between the cylinder walls 14, 14', 15, 15'.

Because of the multiple, alternating approach of the bars 3, 3' to the inner cylinder walls 15, 15' and outer cylinder walls 14, 14' of the associated delivery spaces 11, 11' when the displacer 1 is driven, the result is, on both sides of the bars 3, 3', sickle-shaped working spaces which enclose the operating medium and, whilst the displacer 1 is being driven, are displaced through the delivery spaces 11, 11' in the direction of the outlet 13. In the process, the volumes of these working spaces are reduced and the pressure of the operating medium is correspondingly increased. In relation to the fundamental mode of operation of displacement machines of this type, reference is also made to DE-C-26 03 462.

FIG. 2 reveals that at the inlet 12 a web 17' having the outer cylinder wall 14' is continued in a web 18', which also has the inner cylinder wall 15. This is also correspondingly true at the inlet 12'; the transition here takes place from a web 17 to a web 18. At the free ends of these webs 17, 17', 18, 18' and bars 3, 3', seals 21 are inserted into corresponding grooves. Said seals are used to seal the working spaces with respect to the end walls 28, 28' of the housing 7" and, respectively, with respect to the disk 2.

The driving and the guidance of the displacer 1 are provided by the drive shaft 24, mounted on the housing parts 7, 7', and the guide shaft 27, which is mounted with its axis parallel on the housing part 7 and at a distance from said drive shaft 24. In order to achieve one-to-one guidance of the displacer 1 in the dead point positions, the drive shaft and guide shaft 27 are angularly precisely synchronized with the eccentric arrangements via a positively-locking belt drive 16 (for example a toothed belt). In FIG. 2, 9 symbolizes a toothed-belt pulley which is seated on the drive shaft 24, and 10 symbolizes a toothed-belt pulley, having the same number of teeth, for the guide shaft 27. This double eccentric drive for the displacer 1 ensures that all the points on the two bars 3, 3' execute a circular displacement movement. The displacer 1 thus executes a circular movement without rotating.

The housing part 7 has an essentially flat end wall 28, which runs at right angles to the axis of rotation 59. A stepped-design, end wall of the housing part 7' is designated by 28'. Integrally molded on this wall is the outlet 13, which is constructed like a nozzle and on which a bearing arrangement for the mounting on this side of the drive shaft 24 is supported via webs.

Figure 3:
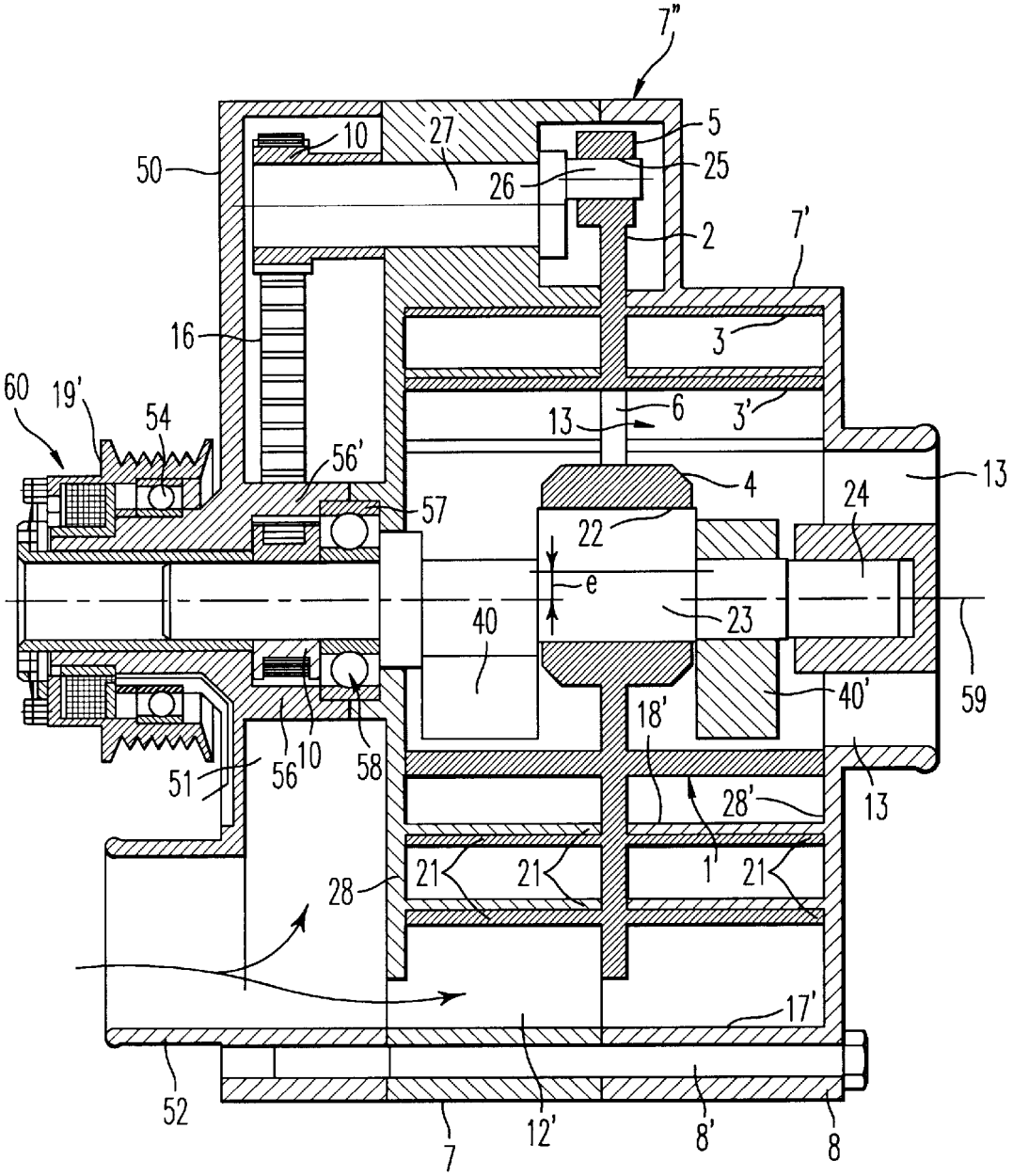
FIG. 3 shows a second embodiment of the inventive displacement machine, in the same illustration as FIG. 1.

FIGS. 1 and 3 show that the openings of the two inlets 12, 12' are arranged to be offset by about 180° in relation to each other on the end wall 28 of the housing part 7. These inlet openings, which run in the axial direction, open into a space 51, which is bounded by a hood 50 and the housing wall 28. The hood 50, which is placed in the axial direction onto the half-housing 7, rests at the end and tightly on the housing wall 28 and, for its part, has a nozzle-like connection 52 which projects in the axial direction and to which a device that is upstream of the displacement machine, for example an air filter (not shown here), can be connected. This arrangement has various advantages: the displacement machine is not broadened in the radial direction by this type of connection between the two inlets 12, 12'. A further advantage of the hood 50 arises from the fact that it has a circularly cylindrical extension 53, which protrudes outward in the axial direction and accommodates a bearing 54. This bearing carries the pulley 19, which is connected in a rotationally fixed manner to the drive shaft 24 by means of a radially resilient element 55. As a result, the radial force that is exerted by a drive belt (not illustrated here) on the extension 53 can be absorbed; the drive shaft 24 is then loaded only by the drive torque. On the inside of the hood 50, extensions 56, 56' protrude from the latter and enclose an outer ring 57 of a rolling-contact bearing 58, via which the drive shaft 24 is mounted on the end wall 28. This measure means that the hood 50 is positioned in a one-to-one manner in the radial direction with respect to the axis of rotation 59 of the drive shaft 24, so that the axis of rotation of the pulley 19 coincides with the axis of rotation 59 of the drive shaft 24. The hood 50 is firmly connected to the half-housings 7, 7' in the axial direction by means of the connecting elements 8'.

A further advantage of combining the inlets 12, 12' by means of the hood 50 is produced by guiding the operating medium past the rolling-contact bearing 58. During machine operation, this bearing is heated up by the shaft 24. Since part of the operating medium—for example cold intake air—then flows through the hood 50 and past the extensions 56, 56', the latter are cooled and, since they enclose the outer ring 57 of the rolling-contact bearing 58, they cool the latter.

A further advantage of the hood 50 with the extension 53 is that the latter is able to accommodate an electromagnetic coupling 60, for example, which is generally known but not specifically described here, instead of the drive pulley 19 that is rotationally fixedly connected to the shaft 24; this is shown in FIG. 3. The appropriate pulley 19', as previously described, is supported on the extension 53 by means of a rolling-contact bearing 54' of the electromagnetic coupling 60.

Figure 4:
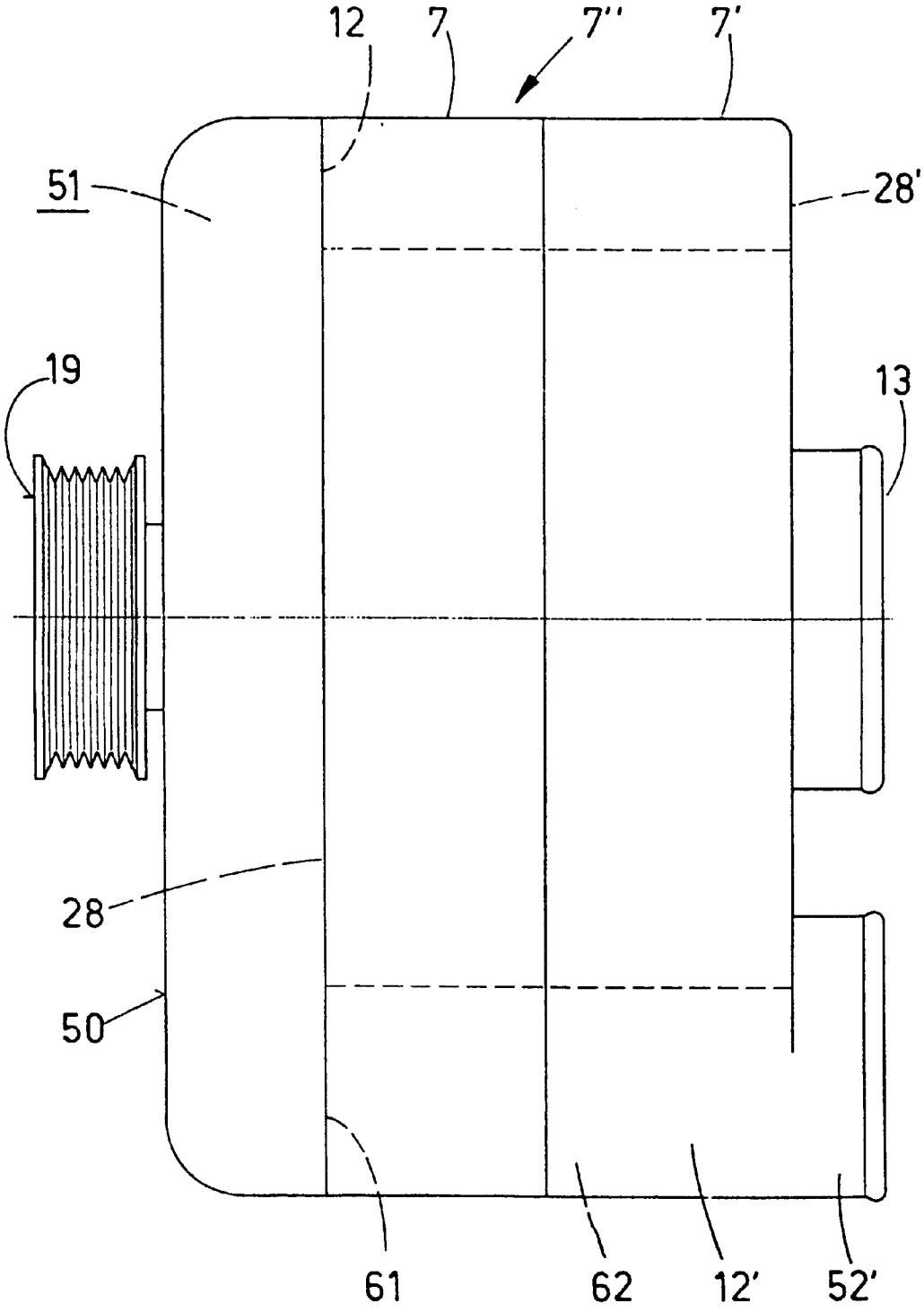
FIG. 4 shows a further embodiment of the inventive displacement machine, in front view.
Figure 5:
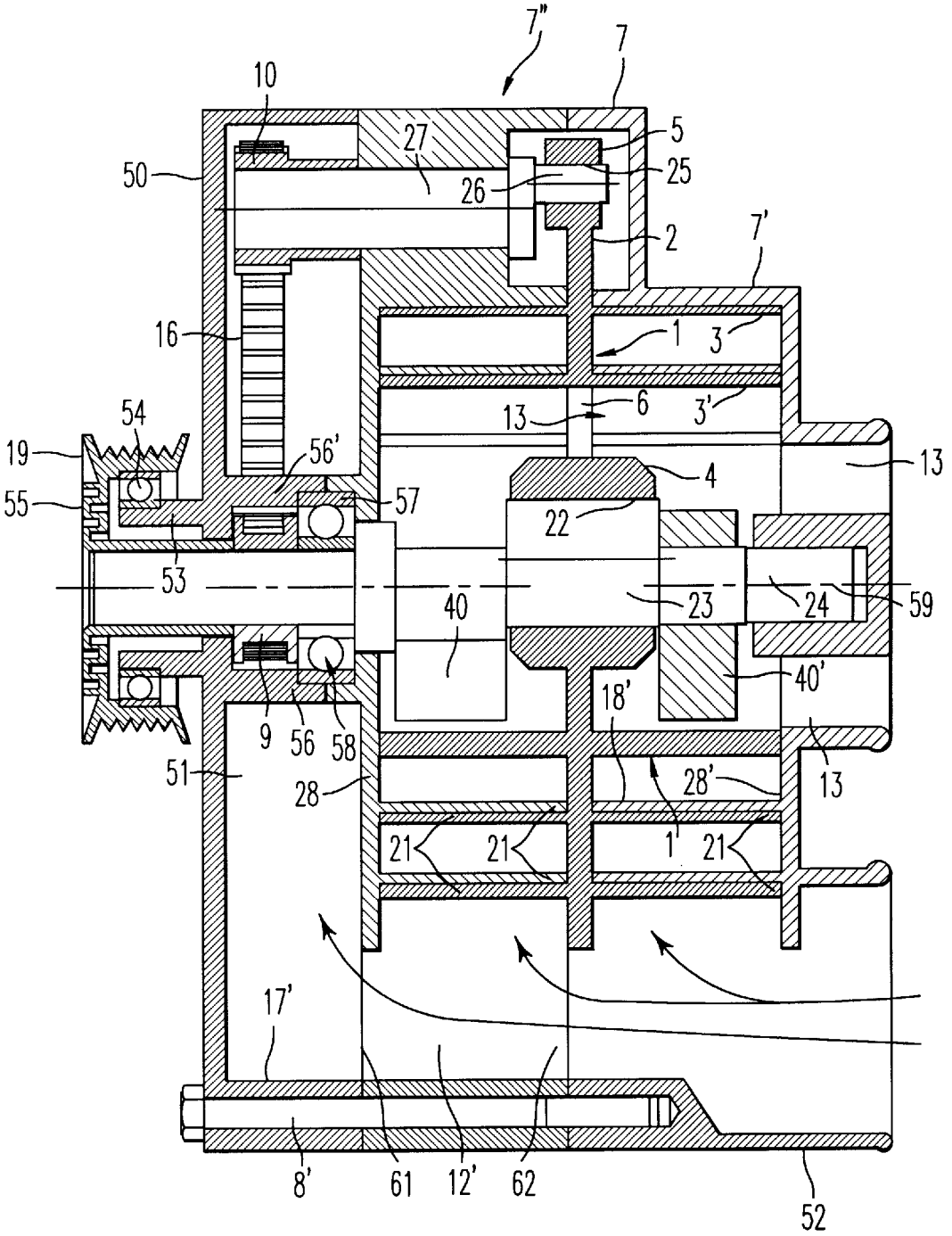
FIG. 5 shows the embodiment of the displacement machine according to FIG. 4 in the same illustration as FIGS. 1 and 3.

In the case of the displacement machine shown in FIGS. 4 and 5, the housing 7" likewise has two housing parts 7, 7' which adjoin each other axially. A displacer 1, which is driven via the pulley 19, is arranged in the housing 7" in the same way as described above and shown in FIGS. 1 to 3. On the drive side of the housing 7", a hood 50 is arranged on the end and, together with the end wall 28 of the housing part 7, bounds the space 51. This end wall 28 has, on one side, the opening of the inlet 12 and, on the other side, approximately diametrically opposite the latter, a passage 61. The passage 61 has a flow connection in the housing 7" via the inlet 12', which is designed as a continuous connecting duct 62, and whose opening is integrally molded in the manner of a connecting nozzle 52' on the end wall 28' of the other housing part 7'. The connection 12 is thus connected to the inlet 12' through the space 51. 13 designates the outlet, which is common to all the delivery spaces but is not shown in FIG. 4. The delivery spaces are designed in the same way as shown in FIGS. 1 to 3 and connected in a corresponding manner to the connecting duct 62 and the inlet 12.

The circumferential shape of the hood 50 is preferably matched to the shape of the housing 7", as can be seen from FIG. 2. However, it is also conceivable for the hood 50 to have a different shape, but preferably not to protrude in the radial direction beyond the housing 7".

It should be mentioned that the openings of the inlets 12, 12' can be arranged on the peripheral side of the housing, and the hood has corresponding extensions in order to cover these openings. In this case, the extensions could have the shape of the housing section which, as FIG. 2 shows, bound the inlets 12, 12'.

The hood 50 can be designed without the extensions 53 and/or 56, 56'.

What is new and desired to be secured by Letters Patent of the United States is:

1. A displacement machine for compressible media, said displacement machine comprising:

a housing with a first end wall and a second end wall;

delivery spaces arranged in said housing so as to lead from at least first and second inlets, which are located radially on an outside of said housing, to an outlet, which is located radially on an inside of said housing;

a displacer provided in said delivery spaces, wherein said displacer is mounted on a drive shaft and a guide shaft, and both said drive shaft and said guide shaft are mounted on said housing;

a disk with spiral bars, wherein said spiral bars are arranged perpendicularly on said disk and are engaged in said delivery spaces, wherein said spiral bars are eccentrically driven, and wherein said spiral bars move circularly along a path bounded by plural walls of said delivery spaces when said displacement machine is in operation;

a hood provided on said housing, wherein said hood and said first end wall together bound a space that connects said at least first and second inlets to each other and wherein said drive shaft and guide shaft are connected to each other, such that said drive shaft and said guide shaft are synchronized to move with each other.

2. The displacement machine according to claim 1, wherein said at least first and second inlets are arranged on said first end wall, and said hood includes a connection through which the compressible media is transferred to said at least first and second inlets.

3. The displacement machine according to claim 2, wherein said housing has a first and a second housing part which adjoin each other in an axial direction, and wherein said first and second housing parts and said hood are joined by a screw fixing.

4. A displacement machine according to claim 2, wherein said hood has an inner extension, which protrudes in a direction of said first end wall and wherein said extensions engages around an outer ring of a centrally arranged bearing which is seated in said first end wall wherein said bearing is configured to receive said drive shaft.

5. The displacement machine according to claim 1, wherein at least a first of said at least first and second inlets is connected through each of said second end wall, a passage, said first end wall, and said space to at least a second of said at least first and second inlets, said at least second of said at least first and second inlets being arranged on said first end wall.

6. The displacement machine according to claim 5, wherein said first end wall is arranged opposite to said second end wall.

7. The displacement machine according to claim 6, wherein said housing has a first and a second housing part which adjoin each other in an axial direction, and wherein said first and second housing parts and said hood are joined by a screw fixing.

8. A displacement machine according to claim 6, wherein said hood has an inner extension, which protrudes in a direction of said first end wall and wherein said extensions engages around an outer ring of a centrally arranged bearing which is seated in said first end wall wherein said bearing is configured to receive said drive shaft.

9. The displacement machine according to claim 5, wherein said housing has a first and a second housing part which adjoin each other in an axial direction, and wherein said first and second housing parts and said hood are joined by a screw fixing.

10. A displacement machine according to claim 5, wherein said hood has an inner extension, which protrudes in a direction of said first end wall and wherein said extensions engages around an outer ring of a centrally arranged bearing which is seated in said first end wall wherein said bearing is configured to receive said drive shaft.

11. The displacement machine according to claim 1, wherein said housing has a first and a second housing part which adjoin each other in an axial direction, and wherein said first and second housing parts and said hood are joined by a screw fixing.

12. A displacement machine according to claim 1, wherein said hood has an inner extension, which protrudes in a direction of said first end wall and wherein said extensions engages around an outer ring of a centrally arranged bearing which is seated in said first end wall wherein said bearing is configured to receive said drive shaft.

13. The displacement machine according to claim 1, wherein said hood has at least approximately circularly cylindrical outer extension, which protrudes outward in an axial direction, wherein said drive shaft engages said outer extension, wherein said outer extension configured to receive a bearing, and wherein said bearing is configured to receive a drive pulley.

14. The displacement machine according to claim 13, wherein an electromagnetic coupling is arranged between said drive pulley and said drive shaft.

* * * * *